US006840394B2

(12) United States Patent
Fleischer

(10) Patent No.: US 6,840,394 B2
(45) Date of Patent: Jan. 11, 2005

(54) CONTAINER CONTROL

(76) Inventor: Susan Fleischer, 16101 Royal Oak Rd., Encino, CA (US) 91436

( * ) Notice: Subject to any disclaimer, the term of this patent is extended or adjusted under 35 U.S.C. 154(b) by 0 days.

(21) Appl. No.: 10/290,963

(22) Filed: Nov. 9, 2002

(65) Prior Publication Data

US 2004/0089628 A1 May 13, 2004

(51) Int. Cl.[7] ..... B65D 39/00
(52) U.S. Cl. ..... 215/355; 215/307
(58) Field of Search ..... 215/50, 355, 246, 215/271, 272, 273, 307, 308, 309, 310, 356, 358; 220/801, 802, DIG. 19; D9/439, 505, 544, 545, 546

(56) References Cited

U.S. PATENT DOCUMENTS

| | | | | | |
|---|---|---|---|---|---|
| 540,921 | A | * | 6/1895 | O'Neill | 215/307 |
| 587,350 | A | * | 8/1897 | Wear | 215/297 |
| 1,188,031 | A | * | 6/1916 | Behrens | 215/307 |
| 1,218,662 | A | * | 3/1917 | Ingram | 215/277 |
| 1,327,519 | A | * | 1/1920 | Bitler | 215/355 |
| 1,785,859 | A | * | 12/1930 | Escher | 215/355 |
| 1,964,469 | A | * | 6/1934 | Karcher | 215/307 |
| 3,057,502 | A | * | 10/1962 | Wood | 215/355 |
| 3,998,349 | A | * | 12/1976 | Megowen | 215/231 |
| 6,138,829 | A | * | 10/2000 | Gidlund et al. | 206/433 |

* cited by examiner

*Primary Examiner*—Kurt Fernstrom
(74) *Attorney, Agent, or Firm*—Robert M. Ashen

(57) ABSTRACT

Apparatus and method for limiting the loss of carbonation from a body of carbonated liquid such as champagne within a container. The apparatus includes a container that has an exit positioned above the liquid. A pouring portion defines a passageway from the interior of the container to the exit. The apparatus also includes a control device that includes an elongated control section and a support section for supporting the control section in the passageway. The control section and the passageway are sized, configured and proportioned relative to one another so that the control section can be within the passageway with a clearance space between it and the passageway wall along the full length of the control section. This allows at least some leeway or latitude in the lateral or transverse positioning of the control section in the passageway. This also allows a single control device to accommodate manufacturing variations in container passageway size, and some different specified size container passageways.

16 Claims, 3 Drawing Sheets

CONTAINER CONTROL

FIELD OF INVENTION

Control of the loss of carbonation from carbonated liquids in containers.

BACKGROUND OF INVENTION

Once a container of a carbonated liquid such as champagne or a carbonated soft drink has been opened and partially used, it is highly desirable to be able to store the container with the remaining champagne without loss or with minimum loss of carbonation. There have been many devices and methods designed to accomplish this task. Some are overly complex or costly. Others require very precise sizing and/or positioning.

SUMMARY OF THE DISCLOSURE

Apparatus and method for controlling the loss of carbonation from carbonated liquid in a container such as champagne in a bottle. The illustrated device comprises an elongated control section having a side surface. The device is proportioned and arranged so that a support section of the device can engage the upper open end of the neck portion of the bottle to thereby support the control section extending down through the passageway of the neck portion. The control section occupies a major portion of the passageway, but the transverse dimension of the control section is sufficiently smaller than the transverse dimension of the passageway so that there is substantial clearance between the outer side surface of the control section and the bottle passageway side wall along the full length of the control section. This allows at least some latitude or leeway in the transverse or lateral positioning of the control section relative to the passageway. This would be advantageous for a user of limited dexterity, such as someone very old, very young or physically impaired. It would also be desirable where visibility is limited as in a darkened area. The device may also be used with different size passageways, including variations within manufacturing tolerances for a given nominal size passageway, or even for some different normal size passageways. The device has been found to significantly reduce the loss of carbonation as compared to the loss when the container is simply left open.

IN THE DRAWINGS

DETAILED DESCRIPTION OF THE DRAWINGS

Figure 1:
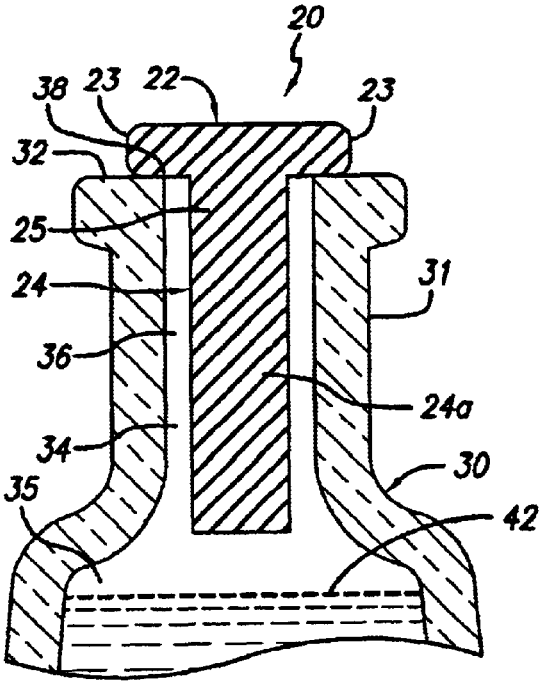
FIG. 1 is a schematic side view of a control apparatus that embodies a presently preferred embodiment of the invention.
Figure 2:
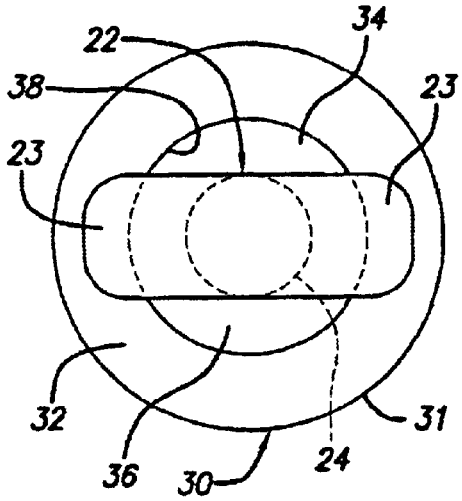
FIG. 2 is a schematic top view of the apparatus of FIG. 1.

FIGS. 1 and 2 show a presently preferred form of apparatus 18 that includes a container 30 for carbonated liquid and a control device 20 for controlling the loss of carbonation from liquid in the container.

For purposes of illustration, the container 30 shown in FIGS. 1 and 2 is a champagne bottle having an upper neck or pouring portion 31 that defines an inner side passageway 34. The passageway 34 has an exit opening 38 at its upper end which is at the upper end 32 of the pouring portion. The passageway 34 is in communication with the interior 35 of the bottle. The bottle 30 is illustrated and described herein as being in a vertical upright position with the exit 38 at the top. It will be understood that the present invention will also work with a container that is tilted, or where the exit even faces to the side, so long as the exit is above the level of the liquid in the container.

In general terms, the illustrated control device 20 includes an elongated control section 24 that is attached at its upper end to a support section 22. When the control device 20 is removably mounted on the bottle 30, the control section 24 extends down through the passageway 34. The control section 24 occupies a major portion of the passageway 34, but it is sized, configured and proportioned relative to the passageway so that the outer side surface 24*a* of the control section can be generally spaced from the passageway wall along the full length of the control section. This allows at least some leeway or latitude in the transverse or lateral positioning of the control section 24 relative to the passageway. The device 20 may also accommodate variation in passageway size. The support section 22 engages the upper end 32 of the bottle pouring portion 31 to support and maintain the control section 24 extending down through the passageway 34. The precise configuration, dimensions or placement within the passageway of the control section do not appear to be critical to effective control of carbonation loss. Therefore, the control device 20 may simply be mounted on the opened bottle 30 without concern as to the precise placement of the control section 24. Further, the support section 22 can be designed, configured, and proportioned with a view to other considerations such as its ease and comfort of handling and its aesthetic appearance.

Now considering the illustrated carbonation-loss control device 20 in further detail, the control section 24 is an elongated upright cylinder. The control section may be of various materials such as metal, heavy plastic, glass, etc.

Attached to the top end 25 of the control section 24 is the support section 22. The illustrated support section 22 is elongated and transversely extending as shown best in FIG. 2. The sections 22, 24 may be constructed from a single piece of material. Alternately the sections 22, 24 could be separate pieces connected to one another.

The container 30 shown in FIGS. 1 and 2 is a glass champagne bottle having a generally upright tubular upper neck or pouring portion 31 with an open upper end 32. The illustrated portion 31 has a generally cylindrical passageway 34 that communicates at its lower end with the interior 35 of the bottle 30. The upper end of the passageway 34 defines an opening or exit 38 at the upper end of the bottle.

When the control device 20 is mounted on the bottle 30 as shown in FIGS. 1 and 2, the outer ends 23 of the transversely extending support section 22 engage the upper end 32 of the bottle neck portion 31, and the control section 24 extends down through the passageway 34. The illustrated cylinder control section 24 generally conforms to the cylindrical passageway 34, but, the outer surface portion 24*a* of the control section 24 is smaller than and thus spaced apart from the inner surface 36 of the passageway 34 for the full length of the section 24. This arrangement has the advantage that the control section does not need to be precisely located relative to the passageway or its inner wall 36. The control section may be off-center and closer to the passageway wall 36 at one place and thus further from that wall at another place without impairing the operation of the device. The section may even be flush against one side of the passageway. Further, the control device 20 may be used with container passageways 34 of various sizes.

Figure 3:
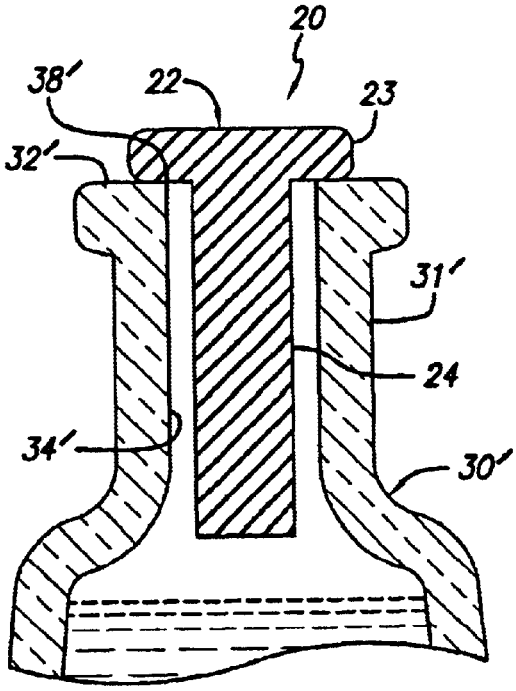
FIG. 3 is a schematic side view like FIG. 1, but showing a somewhat larger container.

FIG. 3 shows the control device 20 used with a container 30' that has a pouring portion 31' with a somewhat wider passageway 34' and exit 38'. The support section 22 is still long enough to span the wider exit 38' to support the control section 24 in the passageway 34'. This illustrates the ability of the control device 20 to be used with containers of varying size passageways.

FIG. 1 shows carbonated liquid such as champagne 40 at a lower level 42 as a result of some of the champagne having been already removed from the bottle 30. The illustrated level 42 is somewhat below the lower end of the control section 24.

The illustrated device 20 has been found to operate very effectively with a bottle or container of champagne, carbonated soft drink or the like. It is also applicant's present belief that the device would operate effectively with other carbonated liquids.

Figure 4:
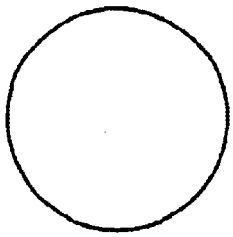
FIGS. 4 through 10 are schematic cross sections of various different alternative control sections.
Figure 5:
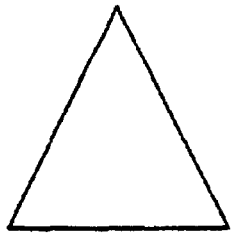
Figure 6:
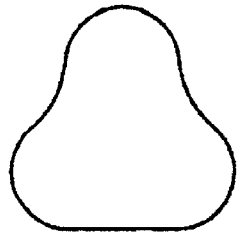
Figure 7:
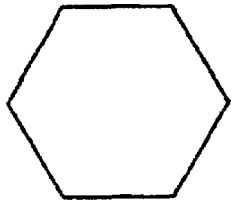
Figure 8:
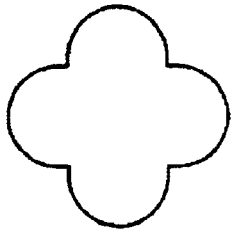
Figure 9:
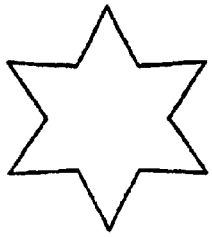
Figure 10:
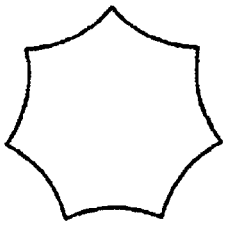

FIGS. 4 through 10 illustrate alternative cross-sections of control section 24 that might be utilized. FIG. 4 illustrates a circular cross-section of the device 20 shown in FIGS. 1 and 2. FIG. 5 shows a triangular cross section, FIG. 6 shows a pear-shaped cross section, FIG. 7 shows a 6-sided cross section, FIG. 8 shows a 4-lobed cross section, FIG. 9 shows a 6-sided star cross section, and FIG. 10 shows a 7 pointed configuration cross section. The alternative cross sections may be selected for reasons of appearance, ease and/or economy of manufacture, etc.

Figure 11:
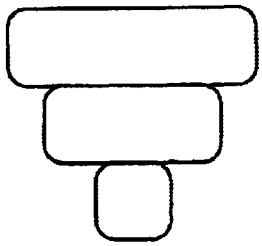
FIGS. 11 through 14 are schematic side views of alternative control sections.
Figure 12:
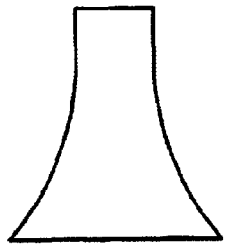
Figure 13:
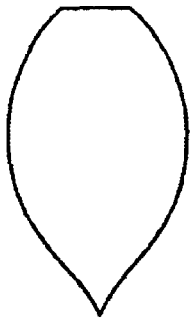
Figure 14:
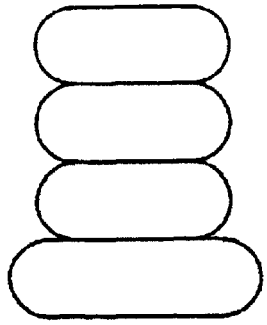

FIGS. 11 through 14 show alternative control sections. FIG. 11 shows a 3-cylinder stack arrangement, FIG. 12 shows a pedestal arrangement, FIG. 13 shows a tear drop arrangement, FIG. 14 shows a stack of 4 disks.

Similarly, the size and configuration of the support portion 22 may vary from that shown in FIGS. 1 and 2. For example, the support section 22 could be circular, oblong, triangular, multi-sided, etc. so long as edge portions of that section would span the exit 38 and thereby support the control section 24. The support section 22 could be highly decorative and virtually any desired shape and look. A decorative and/or functional handle or extension could be attached to the support section.

FIGS. 15A, 15B and 16A, 16B show two alternative support sections.

Generally, different support sections may be matched up with various control sections.

Figure 15A:
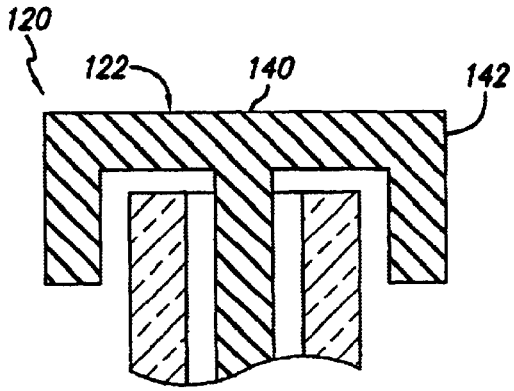
FIGS. 15A and 15B are side sectional and bottom views of an alternative support section.
Figure 15B:
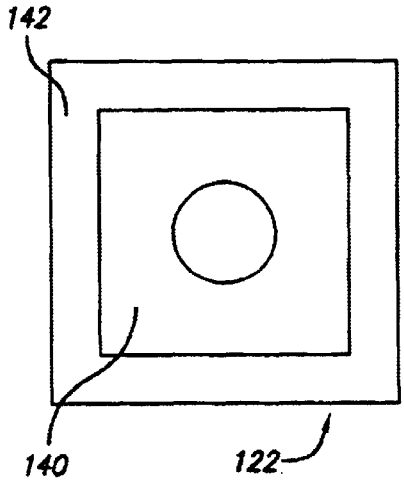

The support section 122 of FIGS. 15A, 15B has a generally square, horizontally extending top portion 140 that rests on the upper end of the bottle and a depending annular lip portion 142.

Figure 16A:
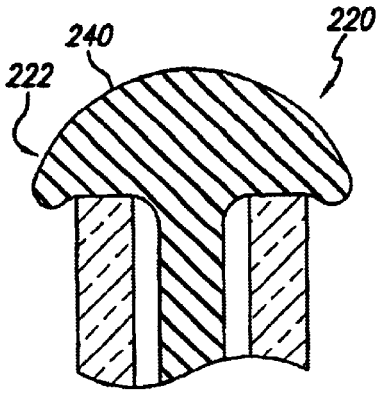
FIGS. 16A and 16B are side sectional and bottom views of an alternative support section.
Figure 16B:
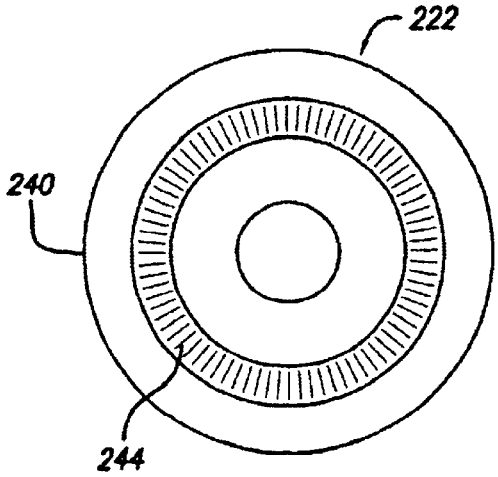

The support section 222 of the device 220 of FIGS. 16A, 16B has a dome shaped top portion 240 that rests on the upper end of the bottle and an annular band 244 that engages the bottle top. A grip or handle 242 is attached to the top portion 240.

Certain tests were conducted with regard to this control device. Initially, four comparison trials were run, each trial comparing one open bottle to a bottle using a present device. It was determined that the present device comparatively limited the amount of carbonation or carbon dioxide release as shown in the following table. Indeed, this comparative limitation of the release of carbon dioxide appeared to become more pronounced with longer periods of time.

| TRIAL | TIME (IN HOURS) | $CM^3$, $CO^2$ RELEASED FROM OPEN BOTTLE | $CM^3$, $CO^2$ RELEASED FROM BOTTLE WITH PRESENT DEVICE |
|---|---|---|---|
| 1 | 70 | 268.1 | 97. |
| 2 | 44 | 217.4 | 116.5 |
| 3 | 40 | 150.5 | 110.3 |
| 4 | 24 | 134.7 | 113.1 |

In further testing, it was determined that, using a standard champagne bottle with a passageway with a diameter of about 1.8 cm, a control section with a maximum transverse or cross-section dimension in the range from about 0.5 cm to about 1.3 cm and with a length in the range from about 4.5 cm to about 13 cm produced effective results. The most favorable results were produced by a control section about 0.75 cm in diameter and about 4.5 cm in length.

The control device of this invention will work even in very large containers of carbonated liquid as long as the size of the device is generally proportionate to the size of the container.

Various modifications may be made to the illustrated structures without departing from the spirit and scope of the present invention as set forth in the following claims.

What is claimed is:

1. Apparatus for limiting loss of carbonation from a body of carbonated liquid in a container, said apparatus comprising:

a) a container for a body of carbonated liquid, said container having a main portion with an interior chamber for holding the liquid, and a generally tubular portion with an interior passageway that is in communication at its lower end with said interior chamber of the container, said passageway being in communication at its upper end with the surrounding atmosphere, said passageway having a side interior wall, and b) a control device comprising:

1) a control section having a side outer surface and being positioned in said passageway, and 2) a support section connected to said control section for engaging said container and removably supporting said control section in said position in said passageway, said support section being proportioned and arranged to provide at least one opening from said passageway to the surrounding atmosphere, said control section side outer surface and said side interior passageway wall being sized, proportioned and configured relative to one another so that the said control section can be generally supported and positioned to occupy a portion of said passageway while providing a continuous clearance space between said control section side outer surface and said passageway side interior wall the full length of said control section to allow at least some latitude in the lateral positioning of said control section in said container tubular portion.

2. The apparatus of claim 1 wherein said control section and said support section are made from a single piece of material.

3. The apparatus of claim 1 wherein said support section is a separate piece of material secured to said control section.

4. The apparatus of claim 1 wherein said passageway has a diameter of about 1.8 cm and said control section has a maximum transverse dimension in the range from about 0.5 cm to about 1.3 cm.

5. The apparatus of claim 4 wherein said control section is about 0.75 cm in maximum transverse dimension.

6. The apparatus of claim 5 wherein said control section extends into said passageway about 4.5 cm from said passageway upper end.

7. The apparatus of claim 1 wherein said control section is generally cylindrical.

8. The apparatus of claim 7 wherein said control section has a generally circular cross-section.

9. The apparatus of claim 7 wherein said control section has a generally oval cross-section.

10. The apparatus of claim 7 wherein said control section has a generally multi-sided cross-section.

11. The apparatus of claim 10 wherein said control section has a generally triangular cross-section.

12. The apparatus of claim 7 wherein said control section has a generally pear-shaped cross-section.

13. The apparatus of claim 1 further including a handle section secured to said support section.

14. The apparatus of claim 1 wherein said container tubular portion has an upper end surrounding said passageway upper end, and said support section is generally elongated and has opposed ends which engage said container upper end at opposite sides of said passageway upper end without blocking of said passageway.

15. A method for limiting the loss of carbonation from a body of carbonated liquid within a container, the container having a generally tubular portion with an interior wall that defines a passageway, the passageway being in communication with the interior of the container and with an exit from the container located above the liquid, the method comprising the steps of:

1) selecting a control device with proportions and size suitable for a particular container, the control device having an elongated control section, the control section occupying a portion of the passageway but being proportioned and sized in relation to the passageway so that, when the control section is in the passageway, the outer surface of the control section can be generally spaced from the passageway wail along the full length of the control section to allow at least some leeway in the transverse positioning of the control section relative to the passageway, and 2) supporting and positioning the control section extending in the passageway without regard to the precise transverse position of the control section in the passageway and so as to provide at least one opening between the passageway and the surrounding atmosphere.

16. Apparatus for limiting loss of carbonation from a body of champagne in a standard size champagne bottle, the bottle having a generally tubular portion with a generally cylindrical interior passageway, the passageway being in communication with the interior of the bottle and with a bottle exit, the passageway having a generally cylindrical interior side wall, said passageway having a standard diameter of about 1.8 cm, said apparatus comprising:

1) an elongated control section for being positioned to extend generally into said passageway, said control section having an outer side surface, and 2) a support section connected to said control section for engaging the bottle to removably support said control section in said position in said passageway, said support section being proportioned and arranged to provide at least one opening from said passageway to the surrounding atmosphere, said control section being sized, proportioned, and configured so that said control section can be generally supported and positioned to occupy a portion of the passageway while providing a clearance space between the interior sidewall of the passageway and said control section side surface for the full length of said control section to allow at least some leeway in the transverse positioning of said control section in the passageway, said side surface having a maximum transverse dimension of about 0.75 cm.

* * * * *